United States Patent [19]

Conrad et al.

[11] Patent Number: 4,554,932

[45] Date of Patent: Nov. 26, 1985

[54] PRESSURE VESSEL AND METHOD OF USING SAME

[75] Inventors: Lucas J. Conrad, Winston-Salem; Jackie L. White, Pfafftown, both of N.C.

[73] Assignee: R. J. Reynolds Tobacco Company, Winston-Salem, N.C.

[21] Appl. No.: 471,580

[22] Filed: Mar. 3, 1983

[51] Int. Cl.[4] ..... A24B 3/18

[52] U.S. Cl. ..... 131/296; 131/290; 131/291; 131/300; 131/901

[58] Field of Search ..... 131/290, 291, 296–298, 131/301, 900–903; 422/242, 292, 297, 300, 301; 99/323.4; 426/443, 445, 447, 449, 450; 138/90, 91

[56] References Cited

U.S. PATENT DOCUMENTS

| | | | |
|---|---|---|---|
| 872,024 | 11/1907 | Smith | 138/91 |
| 2,261,456 | 11/1941 | Warren | 99/323.4 |
| 2,481,013 | 9/1949 | Henderson | 138/90 |
| 3,194,466 | 7/1965 | Davis | 138/90 |
| 3,712,115 | 1/1973 | Miller | 138/90 |
| 4,150,677 | 4/1979 | Osborne, Jr. et al. | 131/297 |
| 4,158,040 | 6/1979 | Miraldi | 422/297 |
| 4,310,006 | 1/1982 | Hibbitls et al. | 131/290 |
| 4,312,369 | 1/1982 | Mullen, III et al. | 131/290 |

*Primary Examiner*—V. Millin
*Assistant Examiner*—Gregory Beaurage
*Attorney, Agent, or Firm*—Grover M. Myers

[57] ABSTRACT

A fluid pressure treating apparatus including a cylindrical tubular shell with a reciprocal spool assembly mounted for movement between a loading position outside the shell and a treating position within the shell, sealing members on said spool assembly for engaging the shell to form the pressure chamber. Conduits are provided to introduce processing fluid into the pressure chamber.

43 Claims, 9 Drawing Figures

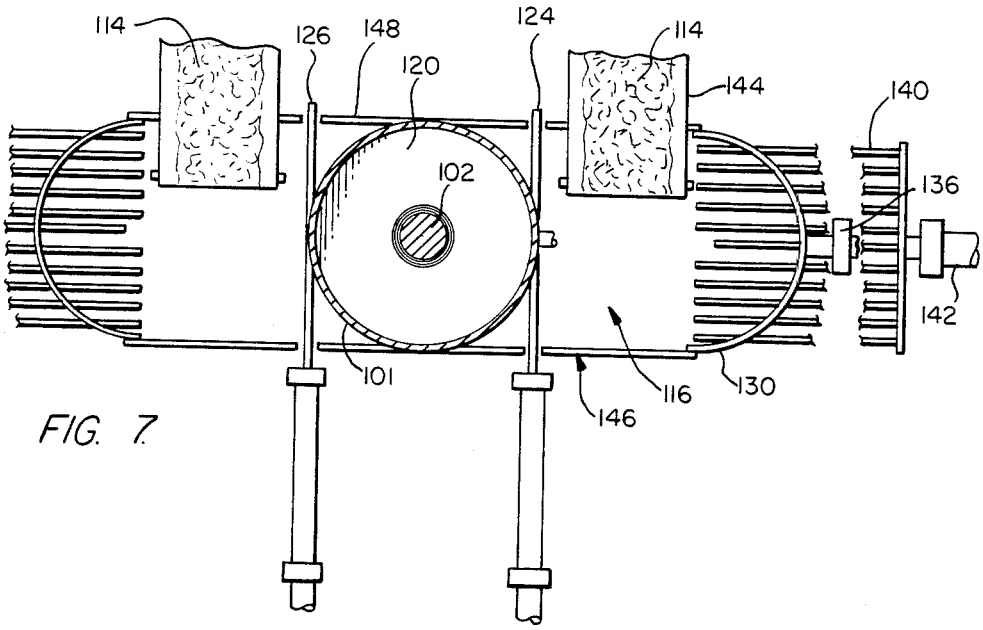
FIG. 7.
FIG. 8A.
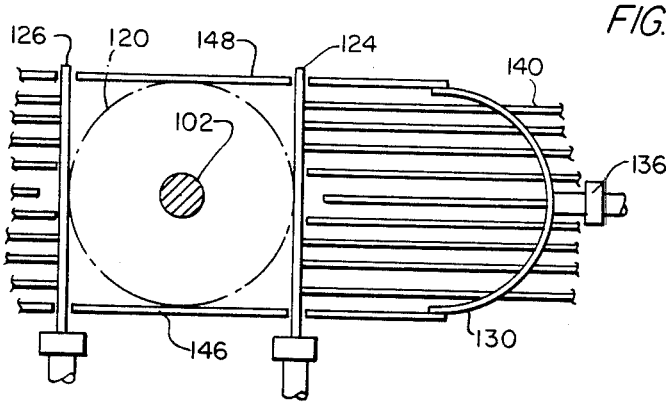
FIG. 8B.
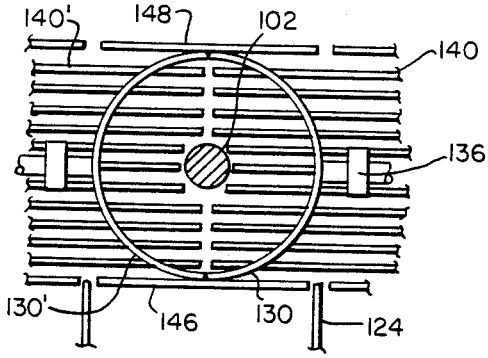

PRESSURE VESSEL AND METHOD OF USING SAME

This invention relates to a unique pressure vessel which can be used in processes utilizing high pressure and, in particular, processes for increasing the filling capacity for tobacco, extraction processes or any other processes where treating materials at high or supercritical pressure is required.

Although the apparatus disclosed can be used for various types of processes mentioned above, this disclosure will be directed primarily to one high pressure use of the apparatus—namely a process for increasing the filling capacity of tobacco.

Some examples of the type of extraction processes which are adaptable to this system are nicotine extraction from tobacco, caffeine extraction for coffee, essential oils from plants and petroleum extraction from coal or shale.

In the presently known processes for expanding tobacco which use high pressure, for example from 200 psig and above, and in most extraction processes, the pressure vessel required is quite bulky having heavy pivotable lids to withstand the pressure. The seal mechanism for the lids are also specially designed to withstand the high pressures. These types of pressure vessels, which are generally referred to as autoclaves, normally have a cylindrical body portion with convex ends, one or both ends being removeable to permit loading and unloading.

One of the primary goals in developing any system is to provide a continuous flow or throughput of material through the system. The only method now known to carry out a high pressure process continuously is to carry out the entire process under pressure. This is not practical, however, because most processes have steps which cannot be carried out at high pressure, therefore, the pressure must be released at some point and the material removed from the pressure vessel. The infeed and outfeed to the pressure treatment step is a principal reason it is difficult, if not impossible, to develop a continuous high pressure process. Most of the high pressure processes are limited by the equipment used, particularly the pressure vessel. Nevertheless, attempts have been made and will continue to be made to develop equipment which will provide for a continuous throughput system for high pressure processes.

The only presently-known arrangement for obtaining a continuous output from a high pressure system where some of the steps are carried out in low pressure is to provide a plurality of pressure vessels which are operated at different time intervals so that a continuous stream of the treated material can be maintained at the outfeed of the pressure step, thus, causing the overall system to have a continuous output. Of course, such a system is not a true continuous system even though it does provide a somewhat continuous flow. Even though no system having high and low pressure steps can be fully continuous, the apparatus used can dramatically decrease the time required to load, seal, pressurize, unseal and unload the pressure vessel, producing a process operating on a generally continuous basis.

In all the presently used tobacco expansion processes, a volatile compound is introduced into the cellular structure of the tobacco which has collapsed due to the curing process. Generally, this step is referred to as impregnation. The impregnated tobacco is then heated to rapidly volatilize the compound causing the tobacco cell to expand as the compound is driven out of the cell in a gaseous or vaporous state. There are a number of processes which utilize this basic concept, some of which are disclosed in U.S. Pat. No. Re. 30,693, U.S. Pat. Nos. 3,524,452; 3,771,533, British Patent Specification No. 1,484,536 and Canadian Pat. No. 1,013,640. The only difference between the processes described in the above patents is the volatile compound used to impregnate the tobacco cells.

It has been found that pressure can be used to reduce the time required to impregnate the tobacco with certain compounds, and the amount of pressure normally used depends on the particular compound used. U.S. Pat. No. 3,524,452 to Stewart et al discloses a process in which a relatively low pressure can be used because the impregnant is normally in a condensed state at these pressures, while in Canadian Pat. No. 1,013,640 and British Patent Specification No. 1,484,536, which disclose processes which use carbon dioxide as the impregnating compound, require a much higher pressure to insure that a sufficient quantity of carbon dioxide is introduced into the tobacco cells to cause expansion of the cells when the impregnated tobacco is heated.

Even though the process and apparatus of the present invention can be used at relatively low pressures, it is more adaptable to the high pressure impregnation such as that disclosed in British Patent Specification No. 1,484,536.

Some of the drawbacks of using any of the presently known high pressure systems are the bulkness of the autoclave and lids, the difficulties with sealing the system, the special basket or container required to hold the material, and, in particular, problems associated with loading and unloading of the pressure vessel.

It is, therefore, important in designing a pressure vessel for use in high pressure materials treatment, particularly tobacco, to have a system which permits easy loading and unloading and eliminates the problems associated with the sealing and locking mechanisms.

SUMMARY OF THE INVENTION

It is, therefore, an object of this invention to provide an apparatus which can be used to treat materials under pressure.

Another object of this invention is to provide a pressure vessel which can be used to treat material at high pressures that can be conveniently loaded and unloaded.

Another object of this invention is to provide a pressure vessel which produces time savings for treating material.

Another object of this invention is to provide an apparatus which can be used in a high pressure process for increasing the filling capacity of tobacco.

Another object of this invention is to provide a high pressure system which utilizes a positionable spool that permits the material being treated to be transported easily into and out of a pressurizing zone and can be loaded and unloaded quickly.

Still another object of this invention is to provide a unique spool structure that permits fluid to be introduced into and removed from the pressure zone without contamination of the fluid with particulate material.

A further object of this invention is to provide a pressure vessel in which a positive means is utilized to load and unload the pressure vessel.

These and other objects are accomplished by the present invention through the use of a spool assembly having two sealable end members and a connecting member which is positionable in a cylindrical tubular shell. The spool reciprocates between a loading and unloading zone where material to be processed is placed about the spool and a pressurizing or treating zone within the tubular shell. Sealing elements on the end members cooperate with the shell to seal and form the sealed pressure vessel. A series of conduits through the shell and/or within the spool assembly permits a fluid to be introduced into and withdrawn from the pressure zone in a uniform manner without permitting material being processed to pass from the pressurized zone with the fluid. Furthermore, when utilized as a system for expanding tobacco, a loading mechanism is provided which permits tobacco to be placed about the spool assembly and an unloading system which removes the tobacco when the spool is in an unloading position.

BRIEF DESCRIPTION OF THE DRAWINGS

FIG. 7 is a section view taken along Line 7—7 of FIG. 6;

FIG. 8A is a section view taken along Line 8—8 of FIG. 6 with the semi-cylindrical enclosure members in the retracted position and the spool assembly in the loading position; and FIG. 8B is a section view taken along Line 8—8 of FIG. 6 with the semi-cylindrical enclosure members in the closed position and the spool assembly in the loading position.

DESCRIPTION OF A PREFERRED EMBODIMENT

Although the spool pressure vessel system as described herein can be used in other types of processes, it is primarily for use in processes for increasing the filling capacity of tobacco; therefore, the description herein shall be directed to the use of the system and method in such processes. It should be understood, however, that the scope of the invention is not so limited. Other types of processes which can utilize the disclosed system are extraction processes, dying processes, or any process requiring pressurized treatment of the material, in particular high or supercritical pressure treatment.

Figure 1:
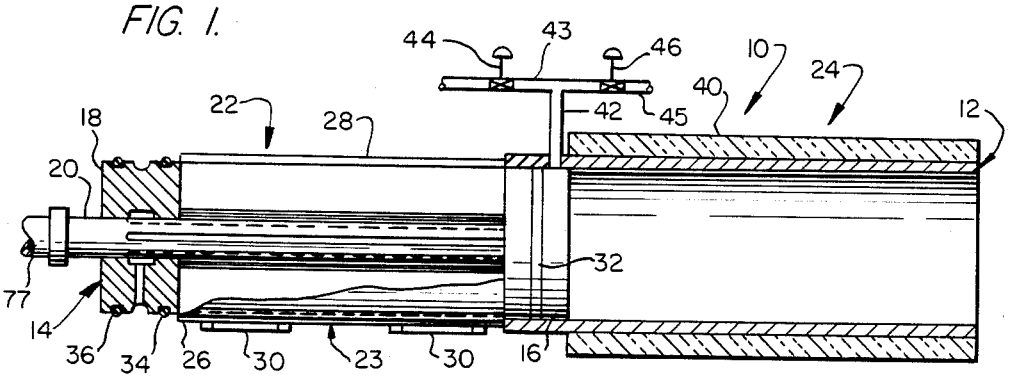
FIG. 1 is a side section view of a spool pressure vessel apparatus according to the present invention with the spool assembly in the retracted or loading position and only portions of the spool assembly cut away.
Figure 2:
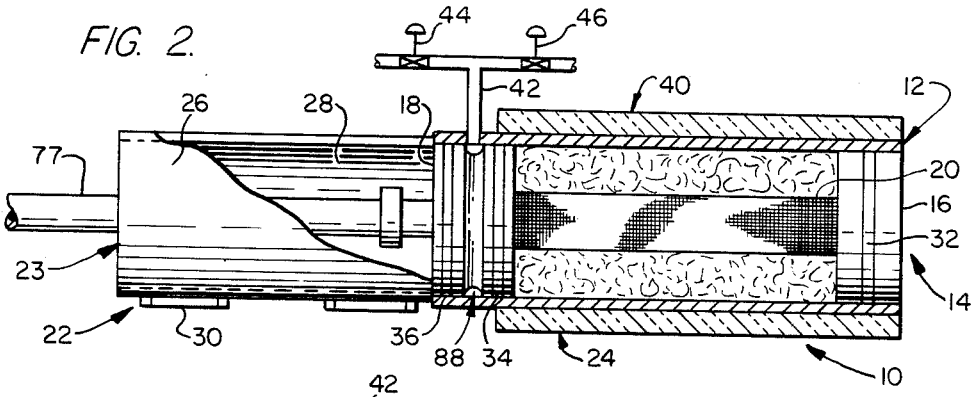
FIG. 2 is a side section view of the spool pressure vessel apparatus with the spool assembly inserted to the pressure vessel shell.
Figure 3:
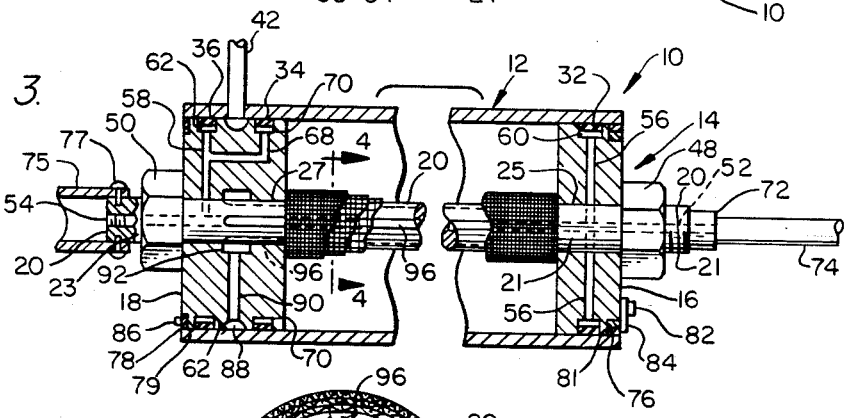
FIG. 3 is a detailed section view of the spool pressure vessel within the pressure zone and illustrating one sealing mechanism and one processing fluid introduction means for the system.

Referring more particularly to the drawings, in FIGS. 1, 2 and 3, the numeral 10 indicates a pressure vessel including a cylindrical tubular shell or enclosure member 12 and a spool assembly 14. The cylindrical shell 12 and the spool assembly 14 can be made of any suitable material, such as stainless steel or the like, but the material selected should be compatible with the materials and procedures used in a specific process.

The spool assembly 14 includes circular or cylindrical shaped end members 16 and 18, corresponding generally in diameter to the inside diameter of the cylindrical tubular shell 12, which are connected together by a connecting rod 20. The spool assembly in the embodiment illustrated has two positions—a loading and unloading position 22, in which the spool assembly 14 is positioned to the left of the shell 12 (see FIG. 1), and a pressurizing or treating position 24, in which the spool assembly 14 is inserted within the shell 12 (see FIG. 2) to form a sealed pressure chamber. A receiving container 23 includes a pair of enclosure members 26 and 28, generally semi-circular in cross sections and secured together by hinges 30, positioned about spool assembly 14 in the loading position 22 contiguous to the shell 12. The enclosure members 26 and 28 when pivoted together form the container to receive tobacco that is distributed in the annular space between the spool connecting rod 20 and enclosure members 26 and 28 (see FIG. 1). The non-hinged edges of the enclosure members located at the top in FIG. 1 do not contact one another, thus, leaving a gap through which the tobacco can be introduced into the annular space. To permit unloading at position 22, the enclosure members are pivoted downwardly so that the treated tobacco can fall away from the spool assembly 14. If desired, the spool assembly can be so constructed and positioned that it can be rotated by an external motor and a scraper or brush assembly (not shown) can be pivoted into position adjacent the connector rod 20 to clean the tobacco particles from the spool assembly. It should be understood that there are numerous other mechanisms and systems which can be used to load and unload the spool assembly.

The spool end members 16 and 18 mentioned above have sealing members which contact the inside surface of the shell 12, thus forming the sealed pressure chamber when the spool assembly is in the pressurizing position 24 (see FIG. 2) so that the connecting rod 20 acts as a tension member to carry loads applied to the end members when the chamber is pressurized. The sealing members maintain pressure integrity within the system during operation. In the illustrated embodiment, there is a single seal member 32 on end 16 and spaced dual seal members 34 and 36 on end 18. Seal member 34 is used primarily to direct processing fluid in a desired manner as will be explained hereinafter. The seal members can function in a number of ways, for example, sealing member can be formed of a generally non-compressible, deformable material which can be squeezed mechanically outward and pressed against the inside surface of the cylindrical shell 12. The sealing member may also be pneumatically or hydraulically inflatable. When inflated, the seals press against the inside surface of the shell member. If a fluid is used to inflate the seals, it should be compatible with the substance being processed in the event a seal leaks.

Figure 5:
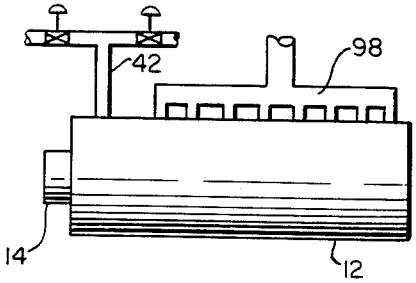
FIG. 5 is a side view of a spool pressure vessel including a fluid manifold which permits the introduction or withdrawal of fluids from the pressure zone.

The sealing system illustrated in FIG. 3 is used when the processing fluid is introduced into the pressure chamber in the manner described herein. However, there are other sealing systems and other methods of introducing the processing fluid into the chamber. For example, only a single seal may be used on end 18 and the processing fluid can be introduced into the pressure chamber via a flexible hose connected to the spool or through the shell 12 by the manifold 98, as shown in FIG. 5 and as described hereinafter. Also, mechanically squeezed seals may be operated by force from processing fluid pressure when evacuation of the chamber is not required during processing.

The sealing system and the processing fluid introduction system of the preferred embodiment are illustrated in detail in FIG. 3. In this particular embodiment, the sealing system is hydraulic. Although the end members 16 and 18 can be secured to the connecting rod 20 in several ways, for example welding, in the illustrated embodiment, the end members 16 and 18 are carried on the connecting rod 20 which has threaded portions 21 and 23 at each end thereof that extends through bores 25 and 27 in the center of end members 16 and 18, respectively. Nuts 48 and 50 hold and secure the end members against annular shoulders on the connecting rod. Such an arrangement permits the spool assembly 14 to be disassembled more easily for maintenance and cleaning.

A central bore 52 extends the length of the connecting rod 20 and is plugged at one end by a set screw 54. End members 16 and 18 have radially extending bores 56 and 58 which connect with the central bore 52 and permit communication between the central bore and annular seal grooves 60 and 62. Elastic seal rings 32 and 36 are carried in the seal grooves 60 and 62, respectively. A right angle bore 68 extends from radial bore 58 in end member 18 to annular groove 70 which carries a seal ring 34.

Fitting 72 is threaded into the central bore 52 at the unplugged end of connecting rod 20 and is connected to a high pressure flexible hose 74, permitting the introduction of fluid under pressure into the sealing system from a fluid source (not shown). A tubular shaft 75 is secured by bolt 77 to opposite end of connecting rod 20. The shaft 77 is connected to a mechanism which moves the spool assembly between loading position 22 and treating position 24.

Around the periphery of the outer face of each end 16 and 18 are annular grooves 81 and 79, respectively, which carry rings 76 and 78. These rings are used to scrape the inside surface of shell 12 as the spool assembly is shifted from one position to another. Of course, only one end will require a scraper ring if the spool is used in a two-position system while both ends will require a scraper ring if a three-position system, as described hereinafter, is used. A bolt 82 and clip 84 are used to hold the ring 76 in position while bolt 86 holds ring 78 in position.

Turning now to the processing fluid system, it has been found that, when utilizing certain types of processing fluids, impregnation of the tobacco can be enhanced if the pressure chamber is maintained at a specific temperature; therefore, the shell 12 can be surrounded by an insulated cover, a fluid bath or the like 40, which can be heated or cooled as desired. In the illustrated embodiment in FIG. 1, the processing fluid or impregnant is introduced into the pressure chamber by a line 42 connecting cylindrical shell 12 and a supply line 43 and inlet valve 44. Recovery line 45 having outlet valve 46 allows the processing fluid to be withdrawn from the system. Supply line 43 is connected to a source of impregnant supply (not shown) while recovery line 45 is connected to a recovery system (not shown) which allows the processing fluid to be recovered and reused. The processing fluid can be in any flowable state such as liquid, vapor, gaseous, etc., when introduced into the system.

Figure 4:
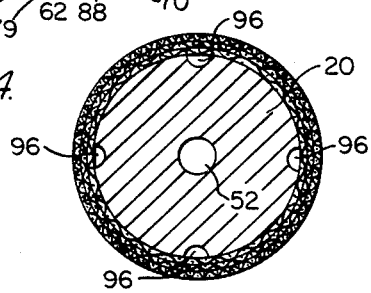
FIG. 4 is a cross section view taken along Line 4—4 of FIG. 3.

The processing fluid is introduced into the pressure chamber through line 43 which is connected by line 42 to the chamber shell 12. Cylindrical end member 18 has an annular outer groove 88 (see FIG. 3) around its peripheral surface and located between the seal members 34 and 36. A plurality of radial bores 90 (only one shown in drawings) extend inwardly from outer groove 88 to an inner groove 92 within bore 27, through which connecting rod 20 is inserted, thus, producing an annular space or passage defined by the inner groove 92 and the connecting rod 20. The connecting rod has a plurality of longitudinal grooves 96 formed in its outer surface which extend from the annular inner groove 92 in end 18 to a point contiguous to the inner face of end member 16. In the illustrated embodiment, four grooves are shown spaced at 90° intervals (see FIG. 4).

Covering the connecting rod between the ends 16 and 18, is a screen or filtering system which utilizes screens of varying meshes from coarse (contacting the connecting rod) to fine (on the outside). The purpose of utilizing the screen system is to prevent product loss and to eliminate expensive separating procedures by preventing any particulate matter entrained in the processing fluid during processing from exiting the chamber into the fluid recovery system, thereby facilitating processing fluid recovery.

It is important to vary the size of the layered screen meshes to prevent clogging; however, the critical layer is the outer layer which must have a very fine mesh that will prevent fluid from passing through unless under pressure. An example of such a layered screen system would range from a coarse mesh of about 8 openings per inch to a fine mesh of about 500 openings per inch. The outer screen is preferably a 1400×250 mesh.

The illustrated apparatus is primarily used for a process to expand tobacco, but by a simple modification, the apparatus can be used for a variety of processes, for example, extraction. This simple modification is the addition of a fluid entrance system or manifold 98 connected directly to the chamber shell 12 (see FIG. 5). By having such a manifold, fluid such as a hot gas, solvent, etc., can be introduced and removed from the chamber in a desired sequence or in combination with the process fluid system for heating, cooling or extracting. If fluid is removed through the manifold system 98, a screen or filtering system similar to the one discussed above may be required to prevent particulate matter from exiting the system.

When using flammable processing fluids in the chamber, the manifold 98 may be used to deliver a purge of inert fluid before or after the processing fluid is introduced or removed, respectively, from the chamber.

One of the primary reasons for utilizing this type of spool assembly arrangement is that the process fluid can be introduced into the material being processed over a shorter distance, thus, requiring less time to complete the process than is normally required in most presently known autoclave systems. For example, the fluid must only travel from the connecting rod 20 or the cylindrical shell 12 through one half of the diameter of the cylindrical shell 12 to contact all of the material in the chamber. Although the spool assembly and chamber can be of any size depending upon the amount of material one desires to process, the spool size is not unlimited in that the advantage of having a short distance for the fluid to travel can be lost if the distance between the connecting rod and shell becomes too great. To obtain quantities greater than one spool can effectively process, a plurality of spools can be used and operated in sequence so that a continuous stream of material is processed and discharged from the overall system.

Figure 6:
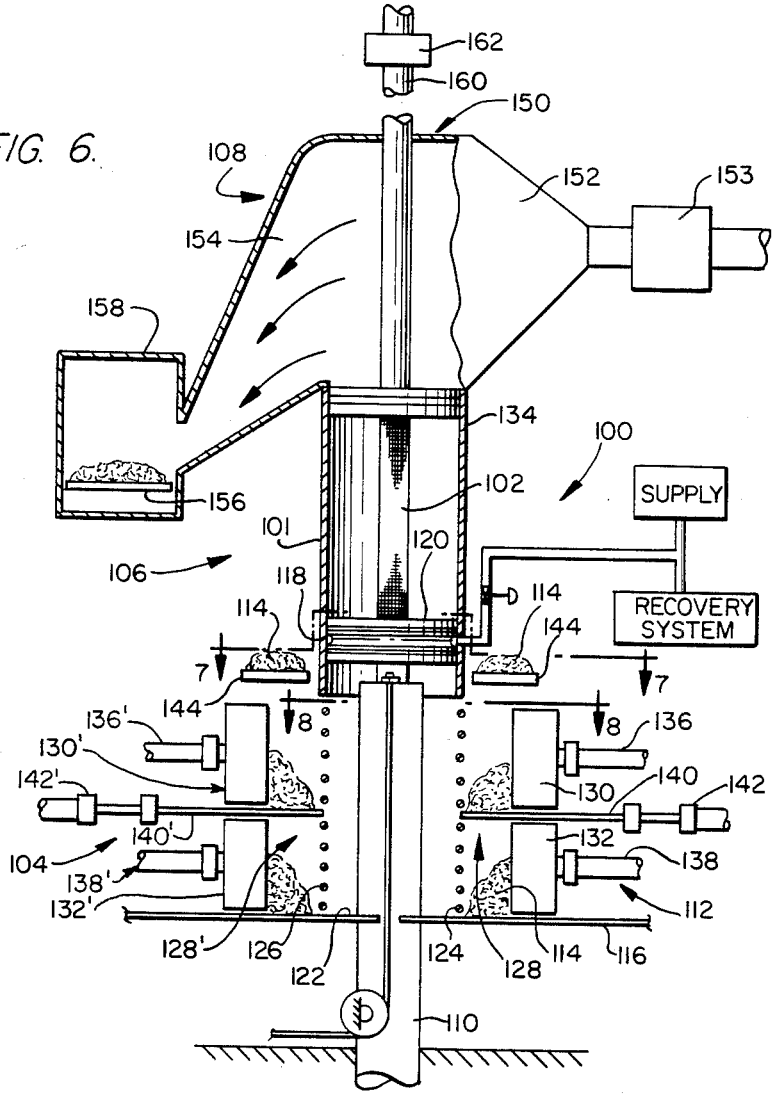
FIG. 6 is a sectional side elevation view of a system which utilizes the spool pressure vessel according to the present invention illustrating one embodiment of a loading and unloading mechanism.

FIGS. 1–5 illustrate a simple version of the spool pressure chamber, however, in order to be commercially practical, an effective system for loading and unloading the spool assembly is required as is illustrated in FIGS. 6, 7, 8A and 8B. In FIG. 6, the spool pressure chamber 100 is arranged so that the axis of the tubular shell 101 and the spool assembly 102 coincide and the spool reciprocates vertically between a lower loading position 104, an intermediate processing position 106 and an upper unloading position 108. The embodiment of the spool assembly 102 is similar to the assembly illustrated in FIGS. 1–5 in that the sealing system and process fluid system can be the same. An insulating covering and fluid manifold described above can be used, if desired.

The spool assembly 102 is carried on a shaft 110 of a lift mechanism (not shown) which can be hydraulically or mechanically operated. In operation, the spool 102 initially begins in the lower loading position where a loading mechanism 112 forms and positions the material 114 around the spool 102. The loading mechanism includes a lower platform or plate 116 which is used to support a portion of the material 114. The plate has a central opening corresponding in size and shape to the end member 118 of the spool 102. When in the loading position, the upper surface 120 of the end 118 is aligned with the upper surface 122 of the plate 116.

Positioned above the plate 116 and adjacent the shaft 110 on opposite sides thereof are vertical tine assemblies 124 and 126 each forming one end of a containment area or accumulating chamber 128 and 128' for the material. The other end of the containment areas are formed by upper and lower closure shells or semi-cylindrical enclosure members 130, 130' and 132, 132', respectively. The closure shells are semicircular in cross sections and, when closed, their configuration conforms to that of the pressure vessel shell 134. The closure shells 130, 130' and 132, 132' are carried by reciprocating piston assemblies 136, 136' and 138, 138', respectively. The piston assemblies move the closure shells from a retracted position as shown in FIGS. 6 and 7 to a closed position adjacent the spool 102 as can be seen in FIG. 8B.

Interposed between the closure shells 130 and 132 and 130' and 132' are intermediate support members or horizontal tine assemblies 140 and 140'. These tine assemblies are used to separate or divide the tobacco in the containment areas 128 and 128' and, thus, prevent compaction. The tine assemblies 140 and 140' is carried by a reciprocating piston 142 and 142', respectively.

When in the retracted position as illustrated in FIG. 7, material 114 from each of the loading conveyors 144 positioned on opposite sides of the spool assembly will deposit material 114 on the base plate 116 until a specified volume or a particular height has been reached. At this event, the horizontal tine assemblies 140 and 140' are reciprocated inwardly as shown in FIG. 8A to an accumulating position and the upper portion of the containment area is filled with a specified amount of material 114. This loading operation can be carried out during the time the spool 112 is in the processing position 106 or the unloading position 108.

When the spool assembly 102 returns to the loading position 104, the horizontal tine assemblies 140 and 140' are reciprocated inwardly until they contact one another contiguous to the spool assembly as can be seen in FIG. 8B. As has been previously mentioned, the upper surface 120 of spool end 118 aligns with the upper surface 122 of plate 116. After the horizontal tines 140 and 140' are in position, vertical tine assemblies 124 and 126 are retracted, thus, permitting shell assemblies 130, 130', 132 and 132' to be reciprocated inwardly, moving the material to a position around the spool connecting rod or shaft. The horizontal tine assemblies 140 and 140' are then extracted and the spool assembly is raised vertically from the loading position 104 to the processing position 106 with the closure shells remaining in the closed position as shown in FIG. 8B. As the spool reaches the processing position, the closure shells 130, 130', 132 and 132' are withdrawn to their retracted position. The vertical tine assemblies 124 and 126 are repositioned or reset so that the containment area 128 is formed to receive a subsequent load of material. It should be understood that the disclosed tine assemblies and closure shells are only illustrative of the various types of mechanical mechanisms which can be used. For example, a single closure shell on each side can be used or a plurality of horizontal tine assemblies may be required if the equipment is extremely large. Furthermore, the closure shells can be a solid piece with openings through which the tine assemblies 140 are inserted. It should also be understood that side plate assemblies 146 and 148, as can be seen in FIGS. 7 and 8A and 8B, are used to contain the material 114 when the shell is in the retracted position. The side members 146 and 148 are spaced sufficiently that the shell members 130, etc., will contact their inside surface and a resilient sealing member can be used which will permit the closure shells to be moved easily within the side members.

If necessary, two clamp collars with outwardly extending tine arrays may be placed on the connecting rod at desirable elevation to hold the tobacco in position in the spool as it is moved into the shell.

After the processing has been completed, the spool assembly is moved from the processing position 106 to the unloading position 108 which includes a housing 150 having a fluid introduction conduit 152 and an exit conduit 154 formed integrally therewith. A fluid such as a gas either heated or cooled as the process dictates is directed by a blower 153 through the housing 150 when the spool assembly 102 is in the unload position. The gas should have a controllable moisture content. The material 114 is blown or forced from the spool assembly through the exit or outlet conduit 154 onto a conveyor 156 for transport to other processing areas. The conveyor can be carried within a closed housing if it is desirable to recover any impregnated vapor which may be escaping from the material or it can be opened to the atmosphere, if desired. The fluid introduced through the housing 150 can be gas, air at room temperature, or it can be steam if heat is required to treat the material 114 after it has been removed from the processing section 106. Furthermore, if heat is required instead of heating the fluid passing through the housing 150, heat can be applied to the material 114 at a later stage (not shown) in the process. For example, an expansion tower as known in the art can be used to receive material from conveyor 156. The shaft 160 of the spool assembly may be spindled and mated with a pinion of gear motor assembly 162, which will permit the shaft to be rotated when it is in the unloading position. If desired, retractable brushes or scrapers (not shown) within the housing 150 can be adapted to brush or scrap the spool assembly clean as the spool is rotated and fluid is forced through the housing. Again, it should be understood that other methods might possibly be used to remove material from the spool depending upon the material being processed and any subsequent processing steps required.

As has been previously mentioned, the primary purpose of the spool assembly and loading and unloading system described and illustrated thus far is to be utilized with a process for increasing the filling capacity of tobacco. In such processes, the tobacco must be impregnated with a material which will become dense or can be condensed sufficiently at the appropriate temperatures and pressures to permit the impregnant to enter into the tobacco cells. A number of impregnants can be utilized, for example, light hydrocarbons, such as ethane, propane, n-butane, halogenerated hydrocarbons, such as trichlorofluoromethane, dichloradifluorethane, argon, carbon dioxide, nitrogen and many other compounds. The primary feature in most tobacco expansion processes is that the impregnating compound be chemically inert to the tobacco. It should, however, be understood that most presently known impregnants will function with this system and operation as described and illustrated herein. Of primary importance in utilizing some of these impregnants, however, is the recovery of such impregnants which will reduce the cost of operation, thereby making the process more economical. Therefore, it is sometimes important to provide a method of returning the impregnant from the spool assembly for recovery and reuse as is known in the art.

Examples of methods which can be used to increase the filling capacity of tobacco, with the above described apparatus, include methods where the tobacco cells are impregnated with a compound which is then removed from the tobacco cells, thus causing expansion in the cells. In such a process the quantity of tobacco to be treated would be placed around the spool assembly and thereafter inserted into the tubular shell. The seals would be expanded to form the pressure vessel. Impregnated compound would be introduced into the pressure chamber in a fluid state under pressure whereby the compound would impregnate the tobacco cells. After impregnation the pressure within the chamber is released and the tobacco is removed from the vessel. Our co-pending U.S. patent application Ser. No. 432,476 filed Oct. 4, 1982 discloses such a process.

A heating step could also be utilized after the tobacco is removed from the pressure vessel to rapidly remove the impregnating compound from the tobacco cells.

The pressure levels used in the process will depend upon the specific compound used as the impregnate; however, it is anticipated that pressure levels at or above the critical point of the impregnating compound would be used. The pressure used will also have an effect on the time required for impregnation. For example, if the impregnating compound is pressurized above its critical point or higher, the period for maintaining the pressure can be quite short, for example, one second. However, as the pressure is decreased from the critical point, the time period for impregnation can increase in the range of a few minutes to hours.

The above described embodiments can be modified in accordance with the subject invention in numerous ways, such as the sealing system, the processing fluid introduction system, etc., Furthermore, the system can be positioned horizontally and utilized in a different material handling system, however, these and other variations and changes can be made in the invention without departing from the true spirit and scope thereof as defined in the following claims.

We claim:

1. A system for use in a process for increasing the filling power of tobacco comprising:

(a) a pressure vessel including a cylindrical tubular shell and a spool assembly means movable between at least a first position outside the shell and a treating position within the shell, said spool assembly including first and second circular end members, connecting rod extending between and securing said first and second end members together and sealing means with at least one sealing member circumscribing each end member, said sealing members contacting the inner surface of said shell when the spool assembly means is in the treating position so that said shell, end members and seal members form a pressure chamber and said connecting rod acts as a tension member to carry loads applied to said end members when such chamber is pressurized;

(b) means for moving the spool assembly means between at least a first position outside said tubular shell and the treating position;

(c) means for loading and unloading material to and from said spool assembly means when said spool assembly means is outside the tubular shell; and (d) means for introducing a processing fluid into said pressure vessel when said spool assembly means is in said treating position, whereby said material contained therein is impregnated with said processing fluid.

2. The system of claim 1, further including means for applying heat to the impregnated material upon removal of said material from the pressure vessel.

3. The system of claim 1, further including means for heating said pressure vessel.

4. The system of claim 1, wherein said sealing means comprises:

(a) a first expandable seal member carried on said first end member;

(b) spaced second and third expandable seal members carried on said second end member; and (c) means for expanding said expandable seal members.

5. The system of claim 4, wherein said means for expanding said seal members includes:

(a) grooves on the outer surface of said end members which carry said expandable seal members;

(b) a bore within said connecting rod;

(c) passageways extending between said seal member grooves and said bore; and (d) means for introducing and removing an inflating fluid into said seal member grooves through said bore and passageways to expand and deflate said expandable seal members.

6. The apparatus of claim 5, wherein the inflating fluid is substantially noncompressible and compatible with tobacco.

7. The apparatus of claim 1, wherein the means for introducing processing fluid in said pressure vessel includes:

(a) a supply line connected to said tubular shell located at one of said end members when said spool assembly is in the treating position;

(b) an annular groove in said end member located on the outer surface thereof;
(c) at least one longitudinal groove extending along the surface of the connecting rod from the inside face of one of said end members to the other;
(d) a passageway extending between the annular groove and said longitudinal groove; and
(e) screen assembly carried on said connecting rod, said screen assembly permitting the processing fluid to pass therethrough under pressure while preventing the tobacco being treated from passing into the longitudinal grooves upon removal of the processing fluid from the pressure vessel.

8. The system of claim 1, wherein said axis of said cylindrical tubular shell and said spool assembly means coincide and are vertically positioned.

9. The system of claim 8, wherein said spool assembly means is movable between first and second positions outside and on opposite sides of said tubular shell and said treating position within said tubular shell, said loading means being located in said first position and said unloading means being located at said second position.

10. The system of claim 9, wherein said loading means includes:
(a) a support member positioned adjacent the upper surface of said lower cylindrical end member when said spool assembly means is in the first position;
(b) spaced side walls on opposite sides of said spool assembly means, defining the sides of a pair of accumulating chambers located on opposite sides of said spool assembly means;
(c) a pair of movable vertical end walls transverse to said side walls, said vertical end walls being located on opposite sides of said spool assembly means and adjacent thereto forming a first end of each of said accumulating chambers;
(d) semi-cylindrical enclosure means on opposite sides of said spool assembly means and located outwardly from said vertical end walls and forming the second end of said accumulating chamber, said enclosure means extending between said spaced side walls;
(e) means for depositing said tobacco into said accumulating chambers at selected time intervals;
(f) means for removing and resetting said vertical end walls from between said side walls; and
(g) means for reciprocating said enclosure means inwardly toward said spool assembly means to form and enclose the tobacco around said spool assembly means prior to movement of said spool assembly means from the first position to the treating position.

11. The system of claim 10, further including means for dividing said accumulating chambers into sections so that said tobacco will be distributed uniformly about said spool assembly means.

12. The system of claim 10, further including an intermediate support means which divides said accumulating chambers into sections, said intermediate support means being reciprocated between a retracted position which permits tobacco to be deposited on said bottom, an accumulating position which permits tobacco to be deposited therein and a loading position contiguous to said spool to permit said inwardly moving enclosure means to form the tobacco about the spool assembly.

13. The system of claim 9, wherein said unloading means includes:
(a) a housing to enclose said spool assembly means said housing having an outlet opening; and
(b) means for removing the treated tobacco from said spool assembly means.

14. The system of claim 13, wherein said housing further includes an inlet opening and said means for removing said treated tobacco includes means for passing a fluid through said housing and through said outlet opening to remove said treated tobacco from said spool assembly means.

15. The apparatus of claim 14, wherein said processing fluid is recovered and reused.

16. The system of claim 13, wherein said means for removing said treated tobacco includes:
(a) means for rotating while said spool assembly means is in said unloading housing; and
(b) scraper means for engaging said treated tobacco as said spool means is rotated whereby said treated tobacco is removed from said spool assembly means.

17. The system of claim 13, further including means for conveying said treated tobacco received from the outlet opening of said housing.

18. The system of claim 17, wherein said means for conveying is enclosed and further includes means for heating said material while in said conveying means.

19. The system of claim 1, further including means for recovering said processing fluid from said pressure vessel after treatment of said tobacco, whereby said recovered processing fluid can be reused.

20. The system of claim 1, further including means for maintaining said pressure vessel at a selected temperature.

21. An apparatus for treating material with fluid under pressure comprising:
(a) a cylindrical tubular shell;
(b) spool means mounted for reciprocation between a first position wherein at least a portion of said spool means is outside said shell and a treating position within said shell, said spool means including first and second cylindrical end members and a connecting rod for spacing and securing said end members together;
(c) sealing means associated with said cylindrical end members and the inside surface of said shell which are engaged when said spool means is in the treating position so that said shell, end members and sealing means form a pressure chamber and said connecting rod acts as a tension member to carry loads applied to said end members when said chamber is pressurized;
(d) means for introducing and removing a processing fluid to and from said pressure chamber; and
(e) means for moving said spool means between said first position and said treating position.

22. The apparatus of claim 21, wherein said sealing means includes a seal member on said end members and conduit means in the spool means to transmit a fluid to the seal member to cause the seal member to expand and engage the inner surface of the cylindrical tubular shell.

23. The apparatus of claim 21, wherein said sealing means includes a seal member on said end members and means to squeeze the seal members causing them to deform and engage the inner wall of the cylindrical tubular shell.

24. The apparatus of claim 21, further including a second fluid introduction means associated with the cylindrical shell for introducing processing fluid into or extracting processing fluid from the pressure chamber.

25. The apparatus of claim 21, further including means for maintaining the temperature of said sealed pressure chamber at a selected level.

26. The apparatus of claim 21, wherein said first position of said spool means is a loading position and further including a second position outside said shell for unloading.

27. The apparatus of claim 26, further including:

(a) means for loading said spool means with a material for treatment at said first position; and (b) means for unloading said spool means at said second position.

28. The apparatus of claim 27, wherein said loading means includes:

(a) a movable shell which encloses said spool means in the loading position to confine the material to be treated prior to said spool being moved into the cylindrical tubular shell; and (b) conveying means for depositing the material within the movable shell.

29. The apparatus of claim 27, wherein said spool is mounted for recriprocation on a vertical axis and said tubular shell is located intermediate to said loading and unloading means.

30. The apparatus of claim 29, wherein said loading means includes:

(a) a support member positioned adjacent the upper surface of the lower cylindrical end member when the spool means is in loading position;

(b) spaced side walls on opposite sides of the spool means, defining the side of a pair of accumulating chambers located on opposite sides of the spool means;

(c) a pair of removable vertical end walls transversed to said side walls, said vertical end walls being located on opposite sides of said spool means and adjacent thereto forming a first end of each of said accumulating chambers;

(d) shell members on opposite sides of said spool means and located outwardly from said vertical end walls and forming the second end of said accumulating chamber, said shell members extending between said spaced side wall;

(e) means for depositing said material into said accumulating chambers;

(f) means for removing and inserting said vertical end walls from between said side walls; and (g) means for reciprocating said shell members inwardly toward said spool means to form and enclose the material around said spool means prior to movement of said spool means from the loading position to the treating position.

31. The apparatus of claim 29, wherein said unloading means includes:

(a) a housing to enclose said spool means, said housing having an outlet opening;

(b) means for removing said treated material from said spool means.

32. The apparatus of claim 31, wherein said housing further includes an inlet opening and said means for removing said treated material includes means for passing a fluid through said housing and through said outlet opening to remove said treated material from said spool means.

33. Apparatus of claim 32, further including means for heating said fluid passing through said housing.

34. The apparatus of claim 31, wherein said means for removing said treated material includes:

(a) means for rotating said spool while said spool is in said unloading housing; and (b) scraper means for engaging said treated material as said spool means is rotated, whereby said treated material is removed from said spool means.

35. The apparatus of claim 31, further including means for conveying said treated material received from the outlet opening of said housing.

36. The apparatus of claim 35, wherein said means for conveying is enclosed and further including means for heating said material while in said conveying means.

37. The apparatus of claim 21, wherein said processing fluid is recovered and reused.

38. The apparatus of claim 21, wherein said processing fluid is used to extract constituents from material being treated.

39. The apparatus of claim 21, wherein said processing fluid impregnates said material.

40. An apparatus for treating material with fluid under pressure comprising:

(a) a cylindrical tubular shell;

(b) spool means mounted for reciprocation between a first position wherein at least a portion of said spool means is outside said shell and a treating position within said shell, said spool means including first and second cylindrical end members and a connecting rod for spacing and securing said end members together;

(c) sealing means associated with said cylindrical end members and the inside surface of said shell which are engaged when said spool means is in the treating position so that said shell, end members and sealing means form a pressure chamber and said connecting rod acts as a tension member to carry the loads applied to said end members when said chamber is pressurized;

(d) means for introducing and removing a processing fluid to and from said pressure chamber including conduit means within said spool to permit the introduction of processing fluid within the center of said material; and (e) means for moving said spool means between said first position and said treating position.

41. The apparatus of claim 40, wherein said conduit means includes grooves on the outer surface of said connecting rod and means for introducing processing fluid into said grooves.

42. The apparatus of claim 41, further including a screen assembly covering said connecting rod for preventing any material particles from passing into said groove when said processing fluid is removed from said pressure chamber while permitting said processing fluid to pass through under pressure.

43. The apparatus of claim 42, wherein said screen assembly includes a plurality of layers of mesh coverings ranging from an inner layer adjacent said connecting rod to an outer layer, said inner layer mesh being about 8 openings per inch and said outer layer being about 1400×250 mesh.

* * * * *

UNITED STATES PATENT AND TRADEMARK OFFICE

CERTIFICATE OF CORRECTION

PATENT NO. : 4,554,932

DATED : November 26, 1985

INVENTOR(S) : Lucas J. Conrad and Jackie L. White

It is certified that error appears in the above—identified patent and that said Letters Patent is hereby corrected as shown below:

Column 12, line 57, after "claim 21" insert --or 40--.

Column 12, line 62, after "claim 21" insert --or 40--.

Signed and Sealed this

*Fifteenth* Day of *April 1986*

[SEAL]

*Attest:*

DONALD J. QUIGG

*Attesting Officer*

*Commissioner of Patents and Trademarks*